United States Patent [19]

Posey

[11] Patent Number: 4,855,719

[45] Date of Patent: Aug. 8, 1989

[54] ELECTRICAL RECEPTABLE ALARM SWITCH

[75] Inventor: William T. Posey, Chickasha, Okla.

[73] Assignee: Hermetic Switch, Inc., Chickasha, Okla.

[21] Appl. No.: 15,175

[22] Filed: Feb. 17, 1987

Related U.S. Application Data

[63] Continuation-in-part of Ser. No. 916,296, Oct. 7, 1986, abandoned.

[51] Int. Cl.[4] ..... G08B 13/14

[52] U.S. Cl. ..... 340/568; 200/51.1; 439/490; 335/207

[58] Field of Search ..... 340/548, 656, 568; 439/489, 490, 488, 491, 245, 133; 335/205, 206, 207; 200/51.09, 51.1, 51 R, 67 F; 324/538

[56] References Cited

U.S. PATENT DOCUMENTS

| | | | |
|---|---|---|---|
| 2,506,171 | 5/1950 | Perillo | 340/656 |
| 3,090,948 | 5/1963 | Cremer | 340/656 |
| 3,114,905 | 12/1963 | Sliman | 340/572 X |
| 3,411,150 | 11/1968 | Schulein | 340/656 |
| 3,781,857 | 12/1973 | Stending et al. | 340/568 X |
| 3,919,705 | 11/1975 | Stendig et al. | 439/490 |
| 3,974,492 | 8/1976 | Girismen | 340/568 X |
| 4,009,474 | 2/1977 | Eller | 40/568 |
| 4,097,843 | 6/1978 | Basile | 340/656 |
| 4,155,082 | 5/1979 | Jones et al. | 340/656 |
| 4,157,542 | 6/1979 | Smith | 439/490 |
| 4,189,723 | 2/1980 | Hylton | 340/568 |
| 4,616,285 | 10/1986 | Sackett | 439/133 |

*Primary Examiner*—Joseph A. Orsino
*Assistant Examiner*—Jill D. Jackson
*Attorney, Agent, or Firm*—Laney, Dougherty, Hessin & Beavers

[57] ABSTRACT

A power receptacle with alarm switch that is actuatable by a standard grounded three-prong plug to output a switch indication. The device consists of at least one three-prong receptacle wherein the third prong contact assures a common or ground connection upon insertion of a three-prong plug. A switch device is secured on the receptacle to extend an actuating arm adjacent the third prong hole in interfering position such that insertion and removal of the plug causes the third prong to move the actuating arm and produce a characteristic switch indication. An improved form of alarm switch uses a hermetically sealed magnetic switch in association with a spring-loaded plunger/magnet assembly to provide corrosion-proof switching.

8 Claims, 4 Drawing Sheets

ELECTRICAL RECEPTABLE ALARM SWITCH

CROSS-REFERENCE TO RELATED APPLICATION

This application is a continuation-in-part of U.S. application Ser. No. 916,296 as filed on Oct. 7, 1986 now abandoned and entitled "Electrical Receptacle Alarm Switch".

BACKGROUND OF THE INVENTION

1. Field of the Invention

The invention relates generally to electrical receptacles and, more particularly, but not by way of limitation, it relates to an improved type of alternating current wall receptacle that includes an integrally formed alarm switch.

2. Description of the Prior Art

Applicant is aware of several prior art devices that teach some form of alarm interconnection relative to an A-C source and plug connection thereto. The prior art devices tend to employ various types of additional structure external from the basic receptacle components as each device appears to apply for a specialized application. Thus, U.S. Pat. No. 3,781,857 discloses a teaching wherein one of the A-C prongs of a plug is used to push a plunger that breaks the contact of an attached switch. Here, the switch is actively associated with an energized prong of the A-C plug. U.S. Pat. No. 3,974,492 teaches a wall receptacle with alarm structure wherein an A-C plug inserted for energization also connects a parallel A-C current to a solenoid which will be held closed in the non-alarm position so long as the A-C plug is positioned in the receptacle. Removal of the plug releases the solenoid energization and sets an alarm. A related U.S. Pat. No. 4,059,843 relates to the same teaching as a divisional application presents claims to the basic structure as utilized with a particular type of overload switch. An earlier teaching in U.S. Pat. No. 3,114,905 teaches an alarm set-up as used with a wall receptacle wherein a magnetic interconnection between the A-C plug and a magnetic field responsive relay within the wall socket coact to provide alarm security. In this case, when the plug is removed and the magnetic force is removed from the interior magnet device, the switch is actuated to give an alarm indication at a remote position. Yet another prior teaching is embodied in U.S. Pat. No. 3,959,790 which teaches a separate interconnect box including indicator light and other mechanical switching apparatus.

SUMMARY OF THE INVENTION

The present invention relates to improved construction of such as an A-C wall receptacle which includes an integral alarm switch that is controlled by the third or ground prong of a conventional three-prong A-C plug. Thus, in addition to carrying out the function of making ground contact, the third prong is also utilized to provide further switch indication, either a ground contact, or an open or closed switch indication when the A-C plug is properly positioned. In a preferred form, the receptacle includes a housing having at least one three-point array of holes for receiving a conventional A-C plug, and having the A-C source contacts disposed for conduction to first and second plug prongs in conventional manner. The receptacle housing also includes a switch device secured thereon and extending an actuating arm into interfering relationship with the third prong of the A-C plug such that removal and insertion of the third prong provides output switch indication indicative thereof. A conventional plural outlet receptacle may be constructed to have the requisite plurality of switch units for actuation by a respective ground prong.

An alternative form of receptacle structure utilizes a single leaf switch means that is positioned in the receptacle housing to be contacted by the ground prong when inserted such that wire interconnection to the contact leaf will conduct a ground indication to a remote alarm device or other ground responsive indicator. Yet another form of alarm switch uses a hermetically sealed magnetic switch to achieve much improved, corrosion-proof operation.

Therefore, it is an object of the present invention to provide a wall receptacle for use in critical applications wherein an alarm switch is contained integrally and at a generally inaccessible position.

It is also an object of the present invention to provide a wall receptacle that may be readily installed for inclusion in alarm systems for protection of critical equipment, high cost office machines, and the like.

It is still further an object of the invention to provide a receptacle with alarm switching indication that is undiscernible from the external view of the receptacle face.

It is yet another object of the invention to provide a corrosion-proof, high reliability receptacle alarm switch.

Finally, it is an object of the present invention to provide a simple and economical low profile alarm switch in combination with an A-C wall receptacle for use in more critical electrical installations.

Other objects and advantages of the invention will be evident from the following detailed description when read in conjunction with the accompanying drawings which illustrate the invention.

DETAILED DESCRIPTION OF THE INVENTION

Figure 1:
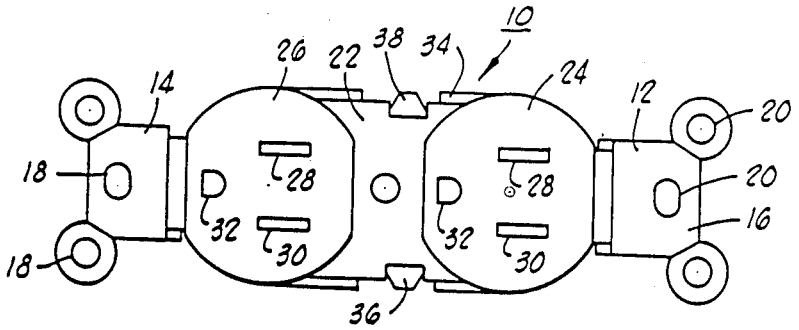
FIG. 1 PRIOR ART
FIG. 1 is a front plan view of a typical dual connector A-C wall receptacle, a type well-known in the prior art.

FIG. 1 illustrates a prior art type of wall receptacle of the type receiving the conventional three-prong, grounded plug interconnection. Thus, a fixture 10 is constructed for wall mounting within a protective box (not shown) and having a decorative face thereover. Receptacle 10 consists of a metal frame 12 extending through the middle of the receptacle and having opposite sides 14 and 16 with respective mounting holes 18 and 20. A unitarily molded front facing 22 includes identical receptacle faces 24 and 26 of the grounded plug type. Thus, each plug face includes a pair of parallel current contact slots 28, 30 and a half-round ground prong hole 32.

The remainder of the housing consists of a molded rear housing 34 that is secured over the backside of plate 12 providing insulation and protection of electrical connections therein. A-C electrical connections are applied on the sides through busses 36 and 38 to supply power to the respective A-C slots 28 and 30. A ground buss (not shown) is disposed inside of the two housing sections and it finds ground connection through plate 12. The receptacle 10 of FIG. 1 is an old and well-known type of fixture that has been in use for a long number of years.

Figure 2:
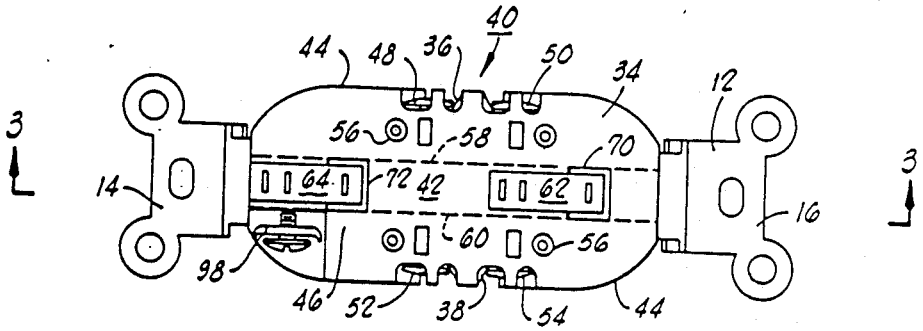
FIG. 2 is a rear plan view of a dual connection receptacle with alarm switches mounted thereon.
Figure 3:
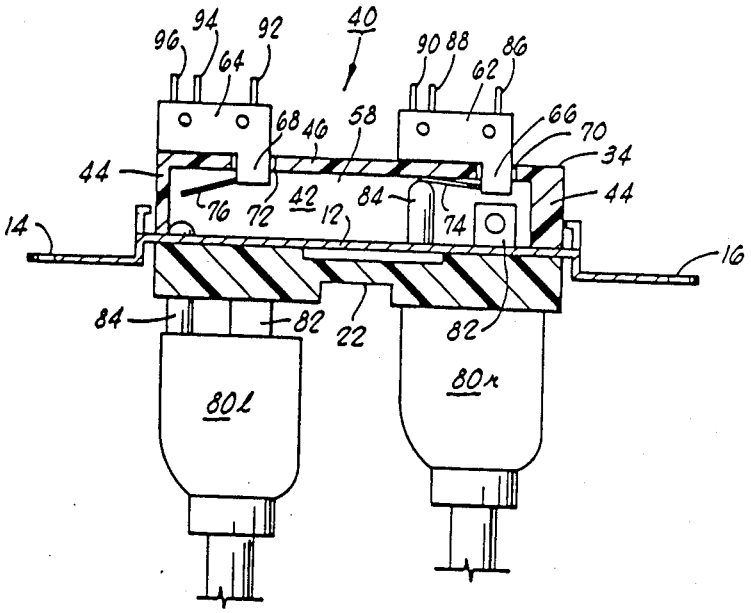
FIG. 3 is a vertical section taken along lines 3—3 of FIG. 2.

FIGS. 2 and 3 illustrate a similar type of fixture that includes additional structure to provide alarm switching. Thus, the same general components are included as in FIG. 1. That is, a central plate 12 supports a housing 40 consisting of a front face 22 and a rear housing 34 which defines an interior central chamber 42. Front face 22 is secured to the plate 12 as well as rear housing 34 by suitable bonding or fastener means. Rear housing 34 is molded in generally rectangular form to have side walls 44 extending from a rear panel or wall 46. The front face 22 and rear housing 34 may be formed from Bakelite or other thermoset plastic material and the front face material is generally selected for color and aesthetic appeal.

A pair of screw connectors 48 and 50 secure source wire connection to buss 36 and one side of the slot connectors 30 while connector screws 52 and 54 provide source connection to the opposite A-C buss 38. Alternatively, wire connections can be made through the respective insert holes 56.

A pair of thin, spaced walls 58 and 60 are formed to extend in parallel through the center of rear housing 34 thereby to define the axial chamber 42 therewithin. Axial chamber 42 defines a space that is well insulated from the A-C current busses 36, 38 on either side of receptacle 40 while defining a central volume wherein switch actuation may take place. Thus, a pair of switches 62 and 64 are secured as by bonding with a suitable agent centrally on the rear wall 46 to extend respective spring-loaded collar elements 66 and 68 down through holes 70, 72 in rear wall 46 of rear housing 34. Each of switches 62 and 64 includes an actuator or switch arm 74 and 76 which is placed in interfering position as regards insertion and proper seating of a mating A-C plug.

As shown in FIG. 3, a conventional ground-coupling A-C plug 80 includes parallel A-C blade prongs 82 coupled with an offset ground prong 84. The left-hand plug **80*l* is shown in the unseated position wherein a A-C contact has not yet been made by blade prongs 82 and the ground prong 84 is not yet in engagement with actuator arms 76 of switch 64. On the right-hand side, plug 80*r* is fully engaged in conducting relationship and the ground prong 84 has moved the actuator arm 74 of switch 62** such that a control or alarm indication is output.

The switches 62 and 64 may be a standard form of microswitch which provide either normally open or normally closed actuations, and such outputs may be connected as required from output contacts 86, 88 and 90 of switch 62 and contacts 92, 94 and 96 of switch 64. While the ground prong 84 is fully inserted to actuate a respective switch, it still functions in electrical communication to the ground lug 98 (FIG. 2) and the interconnected common or ground structure.

Figure 4:
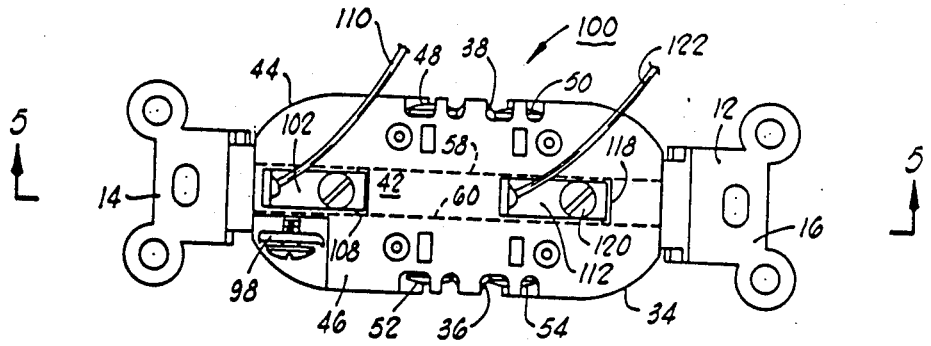
FIG. 4 is a rear plan view of an alternative form of dual connector receptacle with switches.
Figure 5:
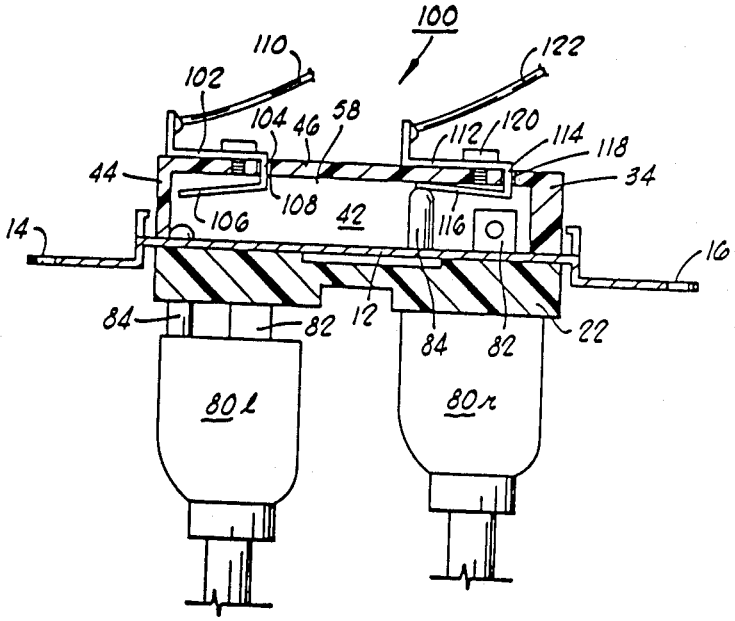
FIG. 5 is a vertical section taken along lines 5—5 of FIG. 4.

FIGS. 4 and 5 illustrate an alternative form of switching receptacle 100 that provides an output indication in the form of a ground actuation. A tab or spring metal strip of contact metal is bent into a right angular formation having a contact 102, a neck portion 104 and a spring member 106. The neck portion is inserted through a hole 108 formed on the longitudinal center line of back panel 46 and secured therein by a set screw or other fastener so that spring portion 106 extends downward into chamber 42 in interfering relationship with axial movement of the ground plug 84 of a coacting A-C plug **80*l*. The ground prong 84 makes contact with the ground buss or connection to receptacle 100, e.g., as applied at lug 98 (FIG. 4), and with full insertion of A-C plug 80*l* the prong 84 contacts spring member 106 to convey a ground connection through the attached lead 110** as applied to a suitable ground-responsive alarm device.

Similar structure is included for the remaining plug connection as a right angular spring metal strip is formed into a contact 112, neck 114 and spring 116. Spring 116 is disposed through a hole 118 and suitably secured as by set screw 120 or equivalent fastener means. A control lead 122 is then connected to the contact 112 such that full insertion of A-C plug **80*r* provides continuity of the ground connection of prong 84 through spring contact 116 and contact 112 to the wire 122. The spring contacts 106 and 116 function within the internal central chamber 42 as formed between longitudinal ribs 58 and 60 that are molded in the rear housing 34 of receptacle 100. In this manner, the ground contacts and interconnection are totally isolated and insulated from the A-C buss connections extending along either side of receptacle 100**.

Figure 6:
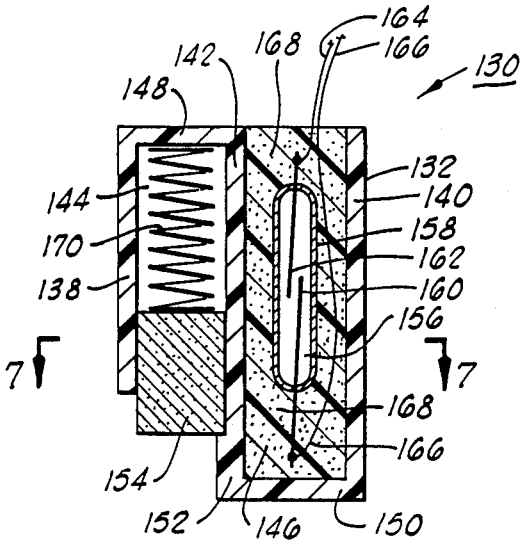
FIG. 6 is a view in vertical section of a magnetic alarm switch assembly constructed in accordance with the present invention.
Figure 7:
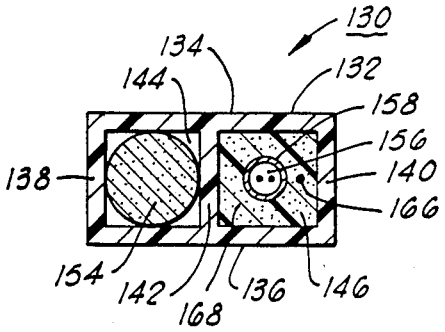
FIG. 7 is a section taken along lines 7—7 of FIG. 6.

An improved form of alarm switch for use with a power receptacle or the like serves to render the combination extremely corrosion-proof, an important factor for switches utilized in harsh environments. Such a corrosion-proof magnetic switch is illustrated in FIGS. 6 and 7. The magnetic switch 130 is formed from a switch housing 132 that is formed to have side panels 134, 136 and edge panels 138, 140, and a center bisecting panel 142 which divides the housing into two, parallel tubular channels 144 and 146. An upper end panel 148 is formed over the end of channel 144 and a lower end panel 150 may be formed to close off the channel 146. In initial molding, a retainer lip 152 may be formed at the lower edge of divider panel 142 to provide a seating for a movable magnetic slug 154.

A magnetically responsive reed switch 156 is secured in generally central position within channel 146. The reed switch 156 is hermetically sealed within a glass envelope 158 and the switch includes reed contact elements 160 and 162, in this case normally open. The reed contact 162 is solder-connected to a wire 164 leading to alarm response circuitry, and the opposite reed contact 160 is connected to a second output lead 166. While the reed switch 156 is shown as a form A type switch (single pole, normally open), it should be understood that a form C reed switch (single pole, double throw) can be readily used. A suitable potting compound 168 may be set around reed switch 156 and leads 164, 166 to position and further encase the switch within channel 146.

The remaining channel 144 is configured to movably retain the magnetic slug 154 as normally seated downward against lip 152 and biased in that position by means of a spring 170 seated against the upper end panel 148. The edge panel 138 may be shortened by removing a bottom portion thereby to facilitate assembly of the switch by allowing the magnetic slug 154 to be easily positioned prior to sealed engagement within the receptacle unit, as will be further described. The magnetic slug 154 may be formed of magnetic material such as alnico, ceramic magnetic material or the like, so long as it is smoothly slidable within channel 144.

As shown in FIG. 6, the reed switch is open as the magnetic slug 154 is not centered in a balanced flux relationship to the ends of reed contacts 160 and 162. Upon urging magnetic slug 154 upward so that the flux field is balanced in relation to the reed contacts 160 and 162, the contacts will close. Control of the switch depends upon the two positions of magnetic slug 154.

Figure 8:
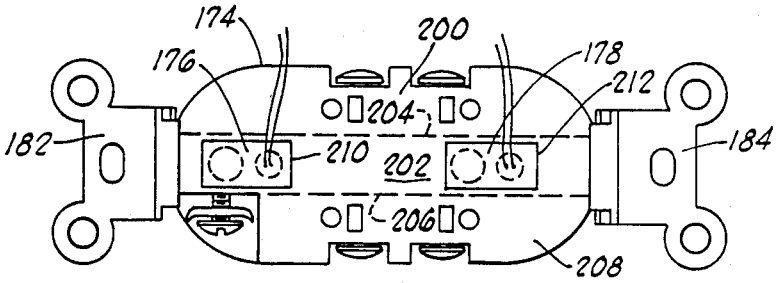
FIG. 8 is a plan view of the rear side of a receptacle with magnetic alarm switches combined.
Figure 9:
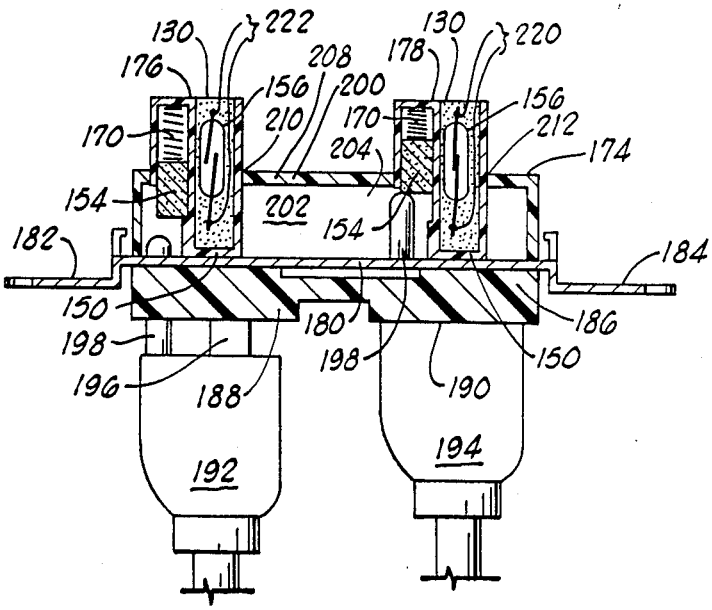
FIG. 9 is a view in side elevation with parts shown in cut-away of the receptacle combination of FIG. 8.

FIGS. 8 and 9 illustrate a two-plug receptacle 174 having corrosion-proof magnetic reed switch assemblies 176 and 178 secured in combination therewith. The receptacle 174 is a conventional type similar to that of FIGS. 2 and 3 as it consists of a metal frame 180 having opposite side tabs 182, 184 in support of a unitary molded front face 186 that forms two receptacle faces 188 and 190 for receiving respective three-prong plugs 192 and 194. Each of plugs 192 and 194 is a conventional type having a pair of parallel, flat prongs 196 coupled with a half-round ground prong 198 disposed in triangular spacing.

The rear side of receptacle 174 is formed with a rear housing 200 having back panel and side walls and forming an interior central chamber 202. The interior chamber 202 is further divided by a pair of parallel spacer walls 204 and 206 which further define the central chamber 202 extending through the longitudinal central portion of receptacle 174. Central chamber 202 is disposed between and well isolated from the hot contacts of the receptacle. The rear panel portion 208 of rear housing 200 is then cut to form rectangular openings 210 and 212, as disposed between interior spacer walls 204 and 206, which receive respective magnetic reed switch assemblies 176 and 178 securely bonded downward therein.

Thus, as shown in FIG. 9, the reed switch assemblies 176 and 178, similar to assemblies 130 of FIG. 6, are secured using suitable bonding agent down within rectangular holes 210 and 212 such that the bottom edge panels 150 are secured flush against metal frame 180, and so that the respective magnetic slugs 154 are in line for engagement with a respective ground prong 198 of three-prong plugs 192 and 194.

As can be noted from FIG. 9, the totally inserted plug 194 has brought ground prong 198 into contact with magnetic slug 154 to raise it against the force of spring 170 to a position where it presents a balanced magnetic flux to the reed switch 156 thereby to close the contacts and present a closed switch indication on alarm output leads 220. Conversely, the remaining plug 92 is not yet fully engaged in its receptacle socket, and the prong 198 has not yet moved magnetic slug 154. Thus, an unbalanced flux field is presented to the magnetic reed switch 156 so that an open alarm switch indication is provided at output leads 222.

It may be readily noted that the magnetic switch assemblies present a highly corrosion-proof element for use in combination with the receptacle 174 as the individual switch assemblies 130 are secured within the inner chamber 202 by means of water-tight, fungus-resistant bonding agent. The individual reed switches 156 are enclosed by potting compound 168 to totally seal off the hermetically sealed element.

Figure 10:
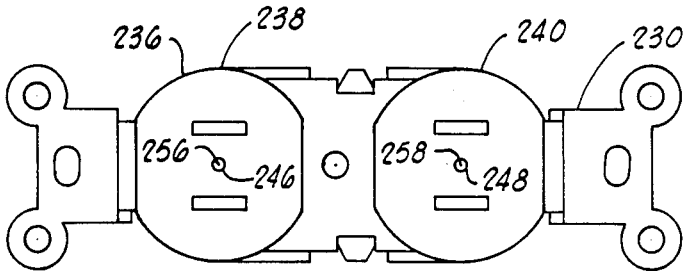
FIG. 10 is a plan view of the face of a double two-prong receptacle having magnetic alarm switches combined.
Figure 11:
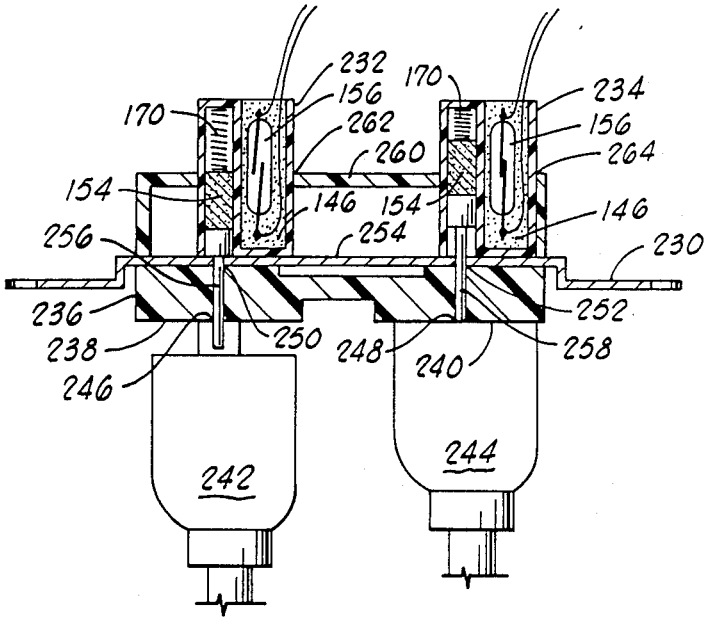
FIG. 11 is a view in side elevation with parts shown in cut-away of the receptacle combination of FIG. 10.

FIGS. 10 and 11 illustrate another alternative structure wherein a dual two-prong receptacle 230 functions in combination with magnetic alarm switch assemblies 232 and 234. The receptacle 230 has a molded front face 236 which defines two identical receptacle faces 238 and 240, each having dual, parallel contact slots for receiving a respective two-prong plug 242 and 244.

Each of receptacle faces 238 and 240 includes a central hole 246 and 248 formed in alignment with holes 250 and 252 in the receptacle frame 254. Thus, respective piston actuators 256 and 258 are disposed for reciprocation through the respective hole pairs 250—246 and 250—248 for the purpose of controlling actuation of the magnetic switch assemblies 232 and 234. The piston type assembly may also be used with grounded or three-prong assemblies.

Here again, switch assemblies 232 and 234 are similar to the magnetic switch assembly 130 (FIG. 6) with the exception that the channel 144 is formed differently with a full edge wall 138 and elimination of the lip portion 152 to enable free channel movement of the piston actuators 256, 258.

The rear housing 260 is formed with rectangular holes 262 and 264 to receive magnetic switch assemblies 232 and 234 downward therein in secure, bonded affixure. Each of piston actuators 256 and 258 is then placed in engagement with a respective magnetic slug 154 functioning under urging of a spring 170. A respective magnetic reed switch 156 is then secured in respective channel 146 as enveloped and secured by potting compound 168 (as shown in FIG. 6).

While the embodiments disclosed and described herein show generally combinative type structure for purposes of best illustrating the invention, it should be understood that the essential and basic functions of alarm responsive A-C connections may be effected by various equivalent structure. Thus, in a commercial construction of the invention, utilizing state of the art plastics molding and formation techniques with the various improved materials, various additional design modes and principles of construction might be employed. It becomes immediately apparent that any high volume manufacture of equivalent alarm switching receptacles may take slightly different forms as such structures are most easily and economically melded into a finished product.

The foregoing discloses a relatively simple structure that is capable of reliable operation in providing an alarm signal indicative of disconnection of a particular power plug. The teachings of the present invention fully contemplate that either a switch ground or a switch disrupt connection may be generated for conduction to a remote location. It is fully contemplated that original installation of wiring and alarm switch receptacles in construction of motels, office buildings and the like will serve to provide a built-in network of equipment monitoring interconnections for control and surveillance at some central point.

Changes may be made in combination and arrangement of elements as heretofore set forth in the specification and shown in the drawings; it being understood that changes may be made in the embodiments disclosed without departing from the spirit and scope of the invention as defined in the following claims.

The embodiments of the invention in which an exclusive property or privilege is claimed are as follows:

1. An alternating current receptacle for receiving connection of at least one plural prong plug, comprising:

housing means having at least one plural point array of contact holes for receiving a respective plug therein;

plural contact means disposed in said housing means as secured in prong contacting relationship adjacent respective contact holes;

a magnetic reed switch having alarm output connections secured to said housing means;

a spring-loaded magnetic slug disposed adjacent the reed switch which is movable between the balanced and unbalanced flux condition relative to said reed switch thereby to actuate said switch between open and closed positions; and means positionable upon complete insertion of a plug to urge said magnetic slug to a position that actuates said magnetic reed switch and initiates an output switch indication from said switch means.

2. Apparatus as set forth in claim 1 wherein said means positionable comprises:

a selected prong of said plug.

3. Apparatus as set forth in claim 1 wherein said means positionable comprises:

a push rod slidably disposed through said housing means and longitudinally movable by said plug to urge said actuation.

4. Apparatus as set forth in claim 1 wherein:

said magnetic reed switch is hermetically sealed in glass.

5. Apparatus as set forth in claim 2 which further includes:

a switch housing defining first and second parallel adjacent channels with said magnetic reed switch secured in the first channel and said magnetic slug movably disposed in the second channel; and a spring disposed in said second channel normally urging said magnetic slug toward the unbalanced flux condition.

6. Apparatus as set forth in claim 5 wherein:

said first channel is filled with potting compound to seal over said magnetic reed switch.

7. Apparatus as set forth in claim 5 wherein:

said magnetic reed switch is hermetically sealed in glass.

8. Apparatus as set forth in claim 7 wherein:

said first channel is filled with potting compound to seal over said magnetic reed switch.

* * * * *

UNITED STATES PATENT AND TRADEMARK OFFICE

CERTIFICATE OF CORRECTION

PATENT NO. : 4,855,719

DATED : August 8, 1989

INVENTOR(S) : William T. Posey

It is certified that error appears in the above-identified patent and that said Letters Patent is hereby corrected as shown below:

In the title, delete "RECEPTABLE" and substitute --RECEPTACLE-- therefor; and
In claim 5 line 1 delete "2" and substitute --1-- therefor.

Signed and Sealed this

Nineteenth Day of June, 1990

*Attest:*

HARRY F. MANBECK, JR.

*Attesting Officer*

*Commissioner of Patents and Trademarks*